US007774183B2

(12) United States Patent
Tardy et al.

(10) Patent No.: US 7,774,183 B2
(45) Date of Patent: Aug. 10, 2010

(54) FLOW OF SELF-DIVERTING ACIDS IN CARBONATE RESERVOIRS

(75) Inventors: Philippe Tardy, Stafford, TX (US); Bruno Lecerf, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 954 days.

(21) Appl. No.: 11/456,778

(22) Filed: Jul. 11, 2006

(65) Prior Publication Data

US 2008/0015831 A1 Jan. 17, 2008

(51) Int. Cl.
*G06F 7/48* (2006.01)

(52) U.S. Cl. ..... 703/10; 166/252.5

(58) Field of Classification Search ..... 703/10; 166/252.2

See application file for complete search history.

(56) References Cited

U.S. PATENT DOCUMENTS

| | | | | |
|---|---|---|---|---|
| 6,196,318 | B1 | 3/2001 | Gong | |
| 6,668,922 | B2 * | 12/2003 | Ziauddin et al. | 166/250.05 |
| 7,114,567 | B2 | 10/2006 | Chan | |
| 7,165,613 | B2 | 1/2007 | Chan | |
| 2004/0093937 | A1 * | 5/2004 | Hashem | 73/152.24 |

OTHER PUBLICATIONS

Gong et al "Quantitative Model of Wormholing Process in Carbonate Acidizing" SPE 1999.*

SPE 52165; M. Gong, A.M. El-Rabba; Quantitative Model of Wormholing Process in Carbonate Acidizing; Society of Petroleum Engineers; 1999; SPE Mid-Continent Operations Symposium in Oklahoma City, Oklahoma; Mar. 28-31, 1999.

SPE 27403; A.D. Hill, Ding Zhu & Yimei Wang; The Effect of Wormholing on the Fluid-Loss Coefficient in Acid Fracturing; SPE Productions & Facilities, Nov. 1995; pp. 257-263; 1994 SPE Formation Damage Symposium in Lafayette, Louisiana Feb. 7-10.

SPE 26578; Y. Wang, A.D. Hill and R.S. Schechter; The Optimum Injection Rate for Matrix Acidizing of Carbonate Formations; Society of Petroleum Engineers; 1993; 68th Annual Technical Conference and Exhibition of the Society of Petroleum Engineers in Houston, Texas; Oct. 3-6, 1993 .

SPE 16887 ; G. Daccord, E. Touboul and R. Lenormand; Carbonate Acidizing: Toward a Quantitative Model of the Wormholing Phenomenon; SPE Production Engineering; 1987; SPE Annual Technical Conference Exhibition in Dallas, Texas; Sep. 27-30, 1987.

SPE 38166; Marten A. Buijse; Understanding Wormholing Mechanisms Can Improve Acid Treatments in Carbonate Formations; Society of Petroleum Engineers; 1997; SPE European Formation Damage Conference in The Hague, the Netherlands; Jun. 2-3, 1997.

(Continued)

*Primary Examiner*—Kamini S Shah
*Assistant Examiner*—Saif A Alhija
(74) *Attorney, Agent, or Firm*—David Cate; Rachel Greene; Robin Nava

(57) ABSTRACT

Two new flow parameters derived from laboratory core-flood experiments are used in building mathematical models to predict the performance of an acid treatment when treatment is made with self diverting fracturing acids. The two new variables are:

ΔPr is defined as the value of Δp (in the core flood experiment) when Δp switches from a first to a second linear trend at time $t_r$.

⊖r is the number of pore volumes injected when the switch occurs.

5 Claims, 11 Drawing Sheets

OTHER PUBLICATIONS

SPE 16886; K.M. Hung, A.D. Hill and K. Sepehrnoorl; A Mechanistic Model of Wormhole Growth in Carbonate Matrix Acidizing and Acid Fracturing; Journal of Petroleum Technology; 1987; SPE Annual Technical Conference and Exhibition in Dallas, Texas; Sep. 27-30, 1987.

SPE 68922; F. Golfier, B. Bazin; C. Zarcone; R. Lernormand, D. Lasseux and M. Quintard; Acidizing Carbonate Reservoirs: Numerical Modelling of Wormhole Propagation and Comparison to Experiments; 2001; SPE European Formation Damage Conference in The Hague in the Netherlands; May 21-22, 2001.

SPE 86504; Bernhard Lungwitz, Chris Fredd, Mark Brady, Matthew Miller, Syed Ali & Kelly Hughes; Diversion and Cleanup Studies of Viscoelastic Surfactant-Based Self-Diverting Acid; Society of Petroleum Engineers; 2004; SPE International Symposium and Exhibition on Formation Damage Control in Lafayette, Louisiana; Feb. 18-20, 2004.

SPE 77369; Mohan K.R. Panga, Vemuri Balakotaiah and Murtaza Ziauddin; Modeling, Simulation and Comparison of Models for Wormhole Formation during Matrix Stimulation of Carbonates; 2002; SPE Annual Technical Conference and Exhibition in San Antonio, Texas; Sep. 29-Oct. 2, 2002.

SPE 86517; Mohan K.R. Panga, Murtaza Ziauddin, Ramakrishna Gandikota and Vemuri Balakotaiah; A New Model For Predicting Wormhole Structure and Formation in Acid Stimulation of Carbonates; 2004; SPE International Symposium and Exhibition on Formation Damage Control in Lafayette, Louisiana; Feb. 18-20, 2004.

G. Daccord, R. Lenormand and O. Lietard; Chemical Dissolution of a Porous Medium by a Reactive Fluid;-I. Model for the "Wormholing" Phenomenon; Chemical Engineering Science; 1992; pp. 169-178; vol. 48 No. 1; Pergamon Press Ltd.; Printed in Great Britain.

G. Daccord, O. Lietard and R. Lenormand; Chemical Dissolution of a Porous Medium by a Reactive Fluid-II. Convection Vs. Reaction, Behavior Diagram; Chemical Engineering Science; 1993; pp. 179-186; vol. 48 No. 1; Pergamon Press Ltd.; Printed in Great Britain.

F. Golfier, C. Zarcone, B. Bazin, R. Lenormand, D. Lasseux and M. Quintard; On the Ability of a Darcy-Scale Model to Capture Wormhole Formation During the Dissolution of a Porous Medium; J. Fluid Mech.; 2002; pp. 213-254; vol. 457; Cambridge University Press; Printed in the United Kingdom.

Gerard Daccord; Chemical Dissolution of a Porous Medium by a Reactive Fluid; The American Physical Society; 1987; pp. 479-482; vol. 58 No. 5; Dowell-Schlumberger; 42003 Saint Etienne Cedex 1, France.

* cited by examiner

75 GAL/FT 15% HCl
0.5 BBL/MIN

75 GAL/FT 15% HCl
1.0 BBL/MIN

75 GAL/FT 15% HCl
2.0 BBL/MIN

75 GAL/FT 15% HCl
5.0 BBL/MIN

75 GAL/FT 15% VDA
0.5 BBL/MIN

75 GAL/FT 15% VDA
1.0 BBL/MIN

75 GAL/FT 15% VDA
2.0 BBL/MIN

75 GAL/FT 15% VDA
5.0 BBL/MIN

FLOW OF SELF-DIVERTING ACIDS IN CARBONATE RESERVOIRS

FIELD OF THE INVENTION

The invention relates to acid stimulation of hydrocarbon bearing subsurface formations and reservoirs. In particular, the invention relates to methods of optimizing field treatment of the formations.

BACKGROUND

Matrix acidizing is a process used to increase the production rate of wells in hydrocarbon reservoirs. It includes the step of pumping an acid into an oil- or gas-producing well to increase the permeability of the formation through which hydrocarbon is produced and to remove some of the formation damage caused by the drilling and completion fluids and drill bits during the drilling and completion process.

In order to predict the outcome in the field of the pumping of an acid, or of acid stages, into a reservoir, engineers go through a design process, which can be divided into several steps. In the first step, for example, core flood experiments are carried out, where different acids are injected, for testing, into cylindrical rock cores under various conditions. During such tests, many parameters can be varied, such as an injection rate Q, a temperature T, an acid formula Ac, and a rock type Ro.

In the core flood experiment, as acid flows into the rock, it dissolves part of the rock matrix and increases the overall permeability of the core with time. Depending on the combination of the above parameters, the dissolution pattern inside the rock can vary between face dissolution (also known as compact dissolution), wormholing dissolution and uniform dissolution. Face dissolution corresponds to the regime where acid flows so slowly that it dissolves the rock through the rock face only, located at the interface between the acid and the core. This interface moves slowly in the flow direction as more and more rock gets dissolved with time. Wormholing dissolution happens when acid flows faster than in the face dissolution regime and not all the acid is spend at the rock face. Live acid enters the core and, due to instable dissolution fronts, fingers of live acids propagate into the rock forming structures known as wormholes. If acid is pumped fast enough for the amount of acid spent during the residence time of the fluid into the core is very small, then, the acid concentration is constant within the rock and the matrix is dissolve in a uniform way. These three known dissolution regimes give rise to different acid efficiencies. Acid efficiency is measured as the amount of acid that is required by the rock core to increase its permeability to a pre-set value $k_w$, for instance 100 times larger than the initial permeability $k_0$ of the sample. The smaller this volume of acid is, the higher the efficiency is. The moment at which this target value of permeability increase is reached is called the breakthrough time, $t_0$. The corresponding volume of acid is called the breakthrough volume, $V_0$.

The measure of pore volumes to breakthrough, denoted $\Theta_0$, (i.e. the breakthrough volume divided by the pore volume of the core PV, where PV is the volume of fluid that can be contained in the core, within the pore network), and its use to predict acid performance during a treatment job has been known to the industry for a long time. For example, pore volume to breakthrough has widely been used as a measure of the velocity at which wormholes propagate into the formation, under various conditions such as mean flow-rate Q, temperature T, rock-type Ro, and acid formulation Ac.

In order to measure pore-volume to breakthrough, acid is pumped at a constant rate Q and the pressure drop $\Delta p$ across the core is monitored. The initial pressure drop when the acid reaches the inlet core face is called $\Delta p_0$. When non-self diverting acids such as hydrochloric and acetic are used, as acid flows into the core, the pressure drop declines, mostly linearly. When $\Delta p$ is virtually equal to 0 (i.e., the core permeability has reached a value $k_w$ orders of magnitude larger than the initial permeability $k_0$) the pore-volume injected is recorded as the pore-volume to breakthrough $\Theta_0$.

Recently, acid systems have been developed with the goal of achieving maximum zonal coverage in heterogeneous reservoirs. Such fluids are designed to self-divert into lower permeability zones of the reservoir after having penetrated and stimulated higher-permeability zones. When such systems are pumped using the same procedure as the one described above, the pressure drop $\Delta p$ across the core may evolve in a very different way as for non-self diverting acids: the pressure does not decline linearly with time and might increase significantly over a certain period of time.

SUMMARY

In various aspects, the methods of the invention are related to the discovery of two new key flow parameters that can be derived from laboratory core-flood experiments, and to their use in building mathematical models to predict the performance of an acid treatment when treatment is made with self diverting fracturing acids. In one embodiment, predictions of the performance of acid treatments based on the models are used to enhance or optimize such treatment.

One important difference in self diverting acid treatment is that the pressure drop $\Delta p$ across the core observed during the core-flood experiment either increases and then decreases with time or decreases with time at two different rates. In particular, it is observed that $\Delta p$ has a piece-wise linear evolution. First, $\Delta p$ evolves according to a first linear relationship with time (or equivalently with volume or pore volume injected). Then, at a certain time $t_r$, it switches to a second linear behavior. Associated with this behavior, two new variables are provided:

- $\Delta P_r$ is defined as the value of $\Delta p$ (in the core flood experiment) when $\Delta p$ switches from the first to the second linear trend at time $t_r$
- $\Theta_r$ is the number of pore volumes injected when the switch occurs.

In various embodiments, the two variables are utilized and exploited in methods of predicting the performance of self-diverting acids. Where necessary, mathematical models and algorithms are developed.

When we use the term "acid" here we include other formation-dissolving treatment fluid components, such as certain chelating agents. Further areas of applicability will become apparent from the description provided herein. It should be understood that the description and specific examples are intended for purposes of illustration only and are not intended to limit the scope of the present disclosure.

DESCRIPTION

Figure 1:
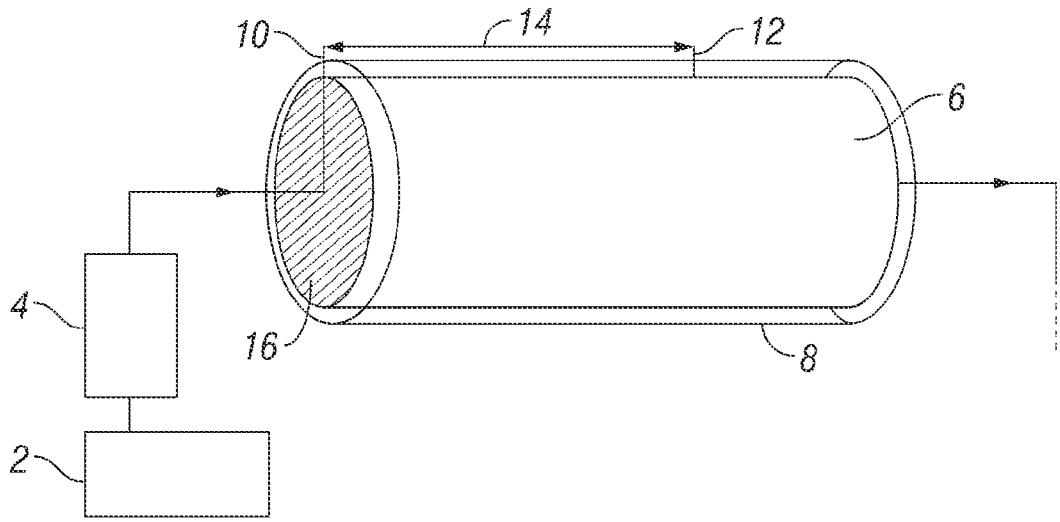
FIG. 1 shows a typical experimental apparatus for acid injection into a rock core.

In one embodiment, the invention provides a method for optimizing the flow rate of a self diverting acid into an acid soluble rock formation during an acid fracturing process. The method comprises predicting treatment performance in the self-diverting acid system on the basis of two flow parameters, the parameters derived from core flood experiments with the self-diverting acid, wherein a fluid is injected into a core and a pressure drop $\Delta p$ is measured against time at a constant flow rate, wherein the flow parameters are $\Delta P_r$, the pressure where a plot of $\Delta p$ vs. time switches from a first linear trend to a second linear trend; and $t_r$ is the time at which the switch occurs.

In another embodiment, the invention provides a method of modeling the pressure in a wellbore during acid treatment with a self diverting acid delivered at a velocity Q, the pressure being determined at a depth z, a distance r from the center of the well, and a time t, the method involving use of functions derived from core flooding experiments wherein a self diverting acid is injected into a core and the pressure along the core is measured as a function of time, the modeling method comprising:

calculating at least one of an effective viscosity $\mu_r$, a mobility $M_r$, and a permeability $k_r$, wherein $$\mu_r = \mu_d \frac{\Delta p_r}{\Delta p_o} \frac{\Theta_0}{\Theta_o - \Theta_r}$$

$$M_r = \frac{k_0}{\frac{\Delta p_r}{\Delta p_0} \frac{\Theta_0}{\Theta_0 - \Theta_r}}$$

and $$k_r = \frac{k_0}{\frac{\mu_d}{\mu} \frac{\Delta p_r}{\Delta p_0} \frac{\Theta_0}{\Theta_0 - \Theta_r}}$$

wherein:

$k_0$ is the initial absolute permeability of the core, before acid is injected;

$\mu_d$ is the viscosity of the displaced fluid originally saturating the core before acid is injected;

$\mu$ is the viscosity of the acid;

$\Delta p_r$ is the pressure drop derived from the core flooding experiments and is the pressure drop at the time $t_r$ that the pressure drop changes from a first linear trend to a second linear trend;

$\Theta_r$ is the number of pore volumes delivered to the core at the time $t_r$;

$\Delta p_o$ is the pressure drop at t=o of the core flood experiment; and $\Theta_o$ is the pore volume to breakthrough measured in the core flood experiment; and calculating pressures within the formation on the basis of the effective viscosity $\mu_r$, the mobility $M_r$, and/or the permeability $k_r$.

In another embodiment, the invention provides a method of optimizing acid treatment of a hydrocarbon containing carbonate reservoir with a self-diverting acid. The method involves:

carrying out linear core flood experiments varying one or more parameters selected form the group consisting of acid formulation, rock type, flow rate, and temperature;

deriving the following functions from the experiments, as a function of the parameters:

$\Theta_o$—the pore volume to wormhole/dissolution front breakthrough;

$\Theta_r$—the pore volume to resistance zone breakthrough; and $\Delta p_r$—the pressure drop at resistance zone breakthrough;

writing equations of a flow model based on the functions;

solving the equations in an arbitrary flow field in a simulator;

using the simulator in an optimization loop together with known and/or estimated reservoir parameters; and calculating at least one of the following from the simulator optimization loop:

stage and rate volumes of the acid treatment;

fluid selection for the acid treatment;

wormhole invasion profile; and skin profile.

In order to predict the outcome of the pumping of an acid, or of acid stages, into a reservoir, engineers go through a design process, which can be divided into several steps. In the first step, different acids are injected, for testing, into cylindrical rock cores, under various conditions. FIG. 1 is an illustration of a typical experimental setup used for injecting acid into a core. A pump [2] pumps a fluid, for example an acid, through an accumulator [4] into a core [6] held in a core holder [8]. During such tests, the following parameters will normally be varied:

Injection rate: Q

Temperature: T

Acid formulation: Ac

Rock type: Ro

As acid flows into the rock, it dissolves part of the rock matrix and increases the overall permeability of the core with time. Depending on the combination of the above parameters, the dissolution pattern inside the rock can vary between face dissolution (also known as compact dissolution), wormholing dissolution, and uniform dissolution. These three dissolution regimes give rise to different acid efficiencies. Acid efficiency is measured as the amount of acid that is required by the rock core to increase its permeability to a pre-set value $k_w$, for instance 100 times larger than the initial permeability $k_0$ of the sample. The smaller this volume of acid is, the higher the efficiency is. The moment at which this target value of permeability increase is reached is called the breakthrough time, $t_0$. The corresponding volume of acid is called the breakthrough volume, $Vol_0$.

The measure of pore volumes to breakthrough, denoted $\Theta_0$, (i.e. the breakthrough volume divided by the pore volumes of the core PV (the volume of fluid that can be contained in the core), and its use to predict acid performance during a treatment job has been known to the industry for a long time. If we define Vol as being the geometrical volume of the core and $\phi_0$ the initial porosity of the core (i.e. the fraction of the core volume that can be occupied by a fluid through the pore space network), these parameters are linked to each other as follows:

$$\Theta_0 = \frac{Vol_0}{PV} = \frac{Qt_0}{PV} \text{ where } PV = \phi_0 \times Vol \quad (1)$$

Pore volume to breakthrough has widely been used as a measure of the velocity at which wormholes propagate into the formation, under various conditions such as mean flow-rate Q, temperature T, rock-type Ro, and acid formulation Ac.

Figure 2A:
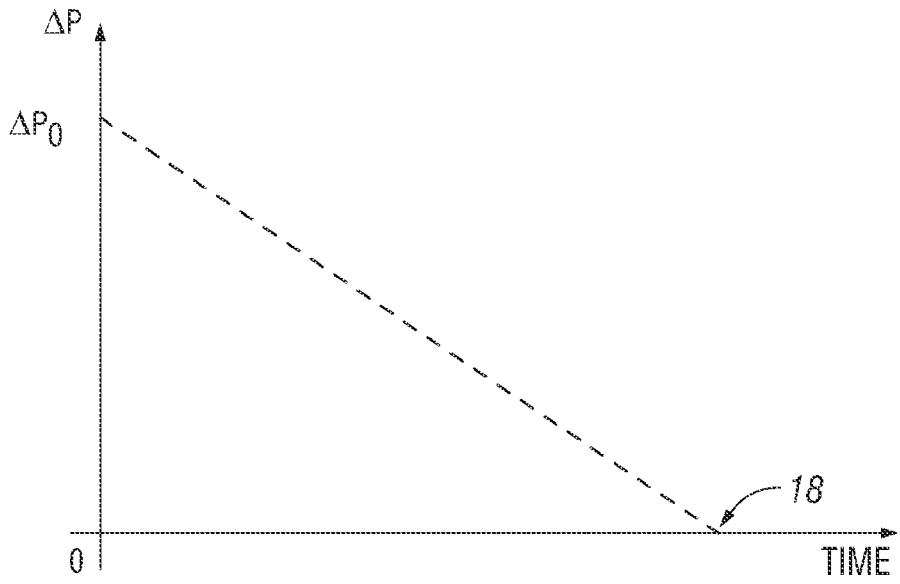
FIG. 2 illustrates pressure-drop for non-diverting acid systems such as HCl. Left: schematic, Right: actual data.
Figure 2B:
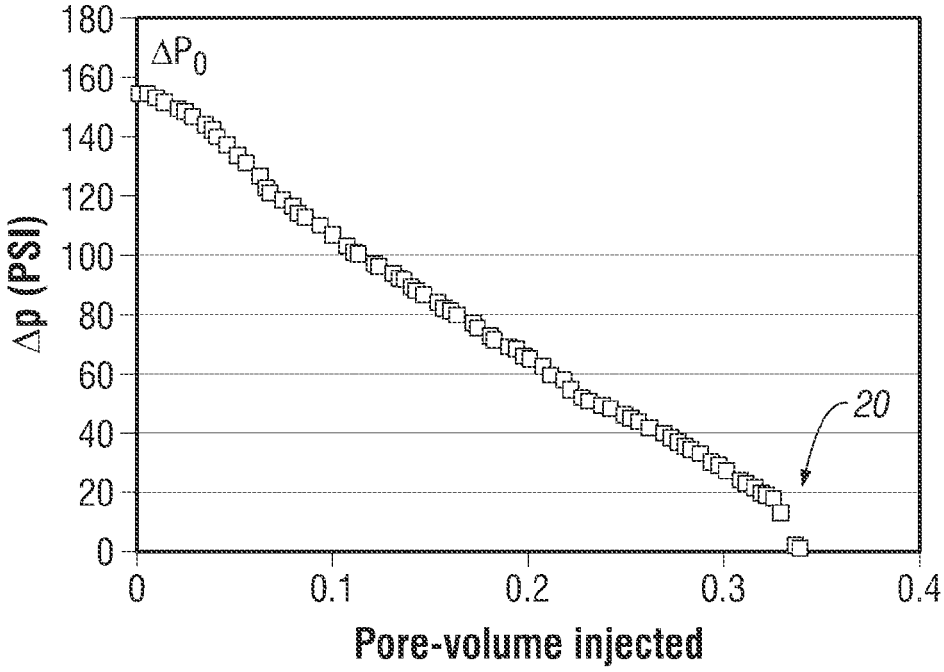

Typically, multiple pressure taps are installed down the length of the core holder; FIG. 1 shows an inlet pressure tap [10], that has an inlet pressure $p_i$, and a second pressure tap [12], that has a pressure away from the inlet $p_L$, at a distance [14], denoted L, from the inlet. The cross sectional area of the core, A, for example at the core face, is shown at [16]. In order to measure pore-volume to breakthrough for a non-self diverting acid, acid is pumped at a constant rate Q and the pressure drop Δp across the core is monitored. The initial pressure drop when the acid reaches the inlet core face is called $\Delta p_0$. Then, as acid flows into the core, the pressure drop declines mostly linearly as illustrated in FIG. 2A, in which the breakthrough time, $t_o$, is shown at [18], and in FIG. 2B in which the pore-volume to breakthrough, $\Theta_0$, is shown at [20]. When Δp is virtually equal to 0 (i.e., the core permeability has reached a value $k_w$ orders of magnitude larger than the initial permeability $k_0$) the pore-volume injected is recorded as the pore-volume to breakthrough $\Theta_0$.

Figure 3A:
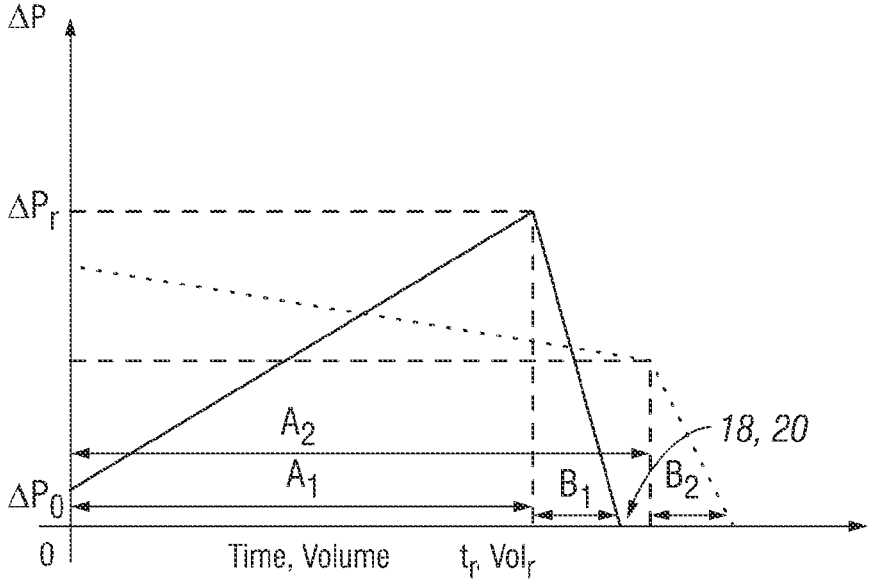
FIG. 3 illustrates pressure drop for self-diverting acid systems such as VDA™. Left: schematic, Right: example of actual data.

More recently, new acid systems, also known as self-diverting acids such as Viscoelastic Diverting Acid (VDA™), have been used to improve the performance of more classical acid systems such as HCI or organic acids. When such systems are pumped using the same procedure as the one described above, very different Δp behavior can be observed, as is illustrated in FIG. 3. FIG. 3*a* illustrates the development of Δp with time of pumping (or equivalently, with volume pumped) at a constant rate for two arbitrary systems designated A and B. Results with one self-diverting acid 1, in rock $R_1$, at temperature $T_1$, and rate $Q_1$, are shown by the solid line; results with another self-diverting acid 2, in rock $R_2$, at temperature $T_2$, and rate $Q_2$, are shown by the dotted line.

One important difference is that Δp may increase and then decrease with time or decrease in two regimes at different rates. In particular, it is observed that Δp has a piece-wise linear evolution. First, Δp evolves according to a first linear relationship with time (or equivalently with volume or pore volume injected) in the regions marked as A1 and A2 for two illustrative fluids. Then, at a certain time $t_r$, (or volume $Vol_r$) it switches to a second linear behavior, as depicted by B1 and B2 in FIG. 3*a*. Associated with this behavior, we define two new parameters $\Delta P_r$ (see FIG. 3*a*) and the number of pore-volumes to reach $\Delta p_r$, denoted $\Theta_r$. $\Delta p_r$ is defined as the value of Δp when Δp switches from the first to the second linear trend at time $t_r$. The parameter $\Theta_r$ is given by:

$$\Theta_r = \frac{Vol_r}{PV} = \frac{Qt_r}{PV} \quad (2)$$

where PV is the pore volume of the core, measured by known methods to determine the volume of liquid held in the core at saturation.

Figure 3B:
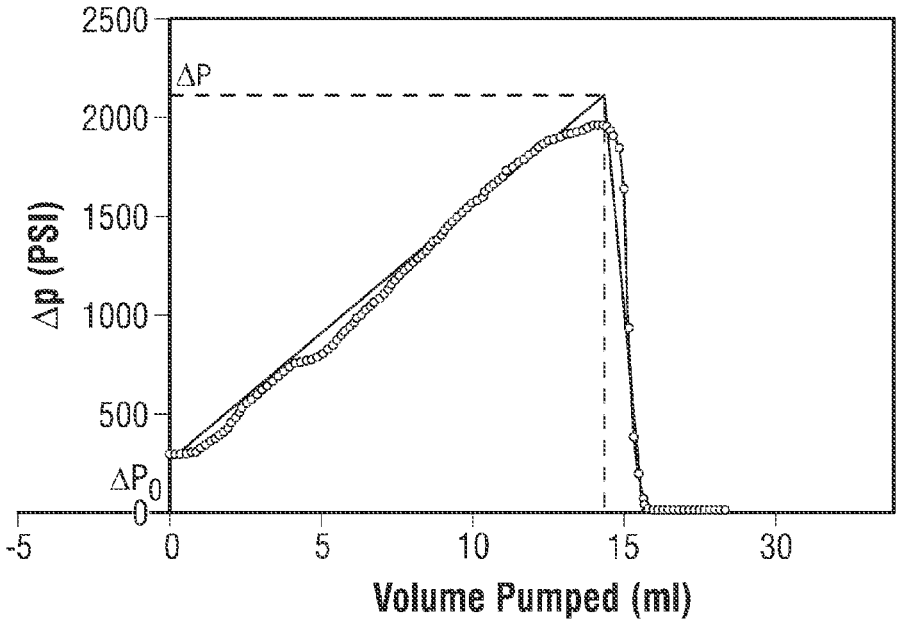

These two parameters constitute a means of predicting the performance of self-diverting acids when used in mathematical models and algorithms as will be explained below. Real data are shown in FIG. 3*b*.

Figure 4:
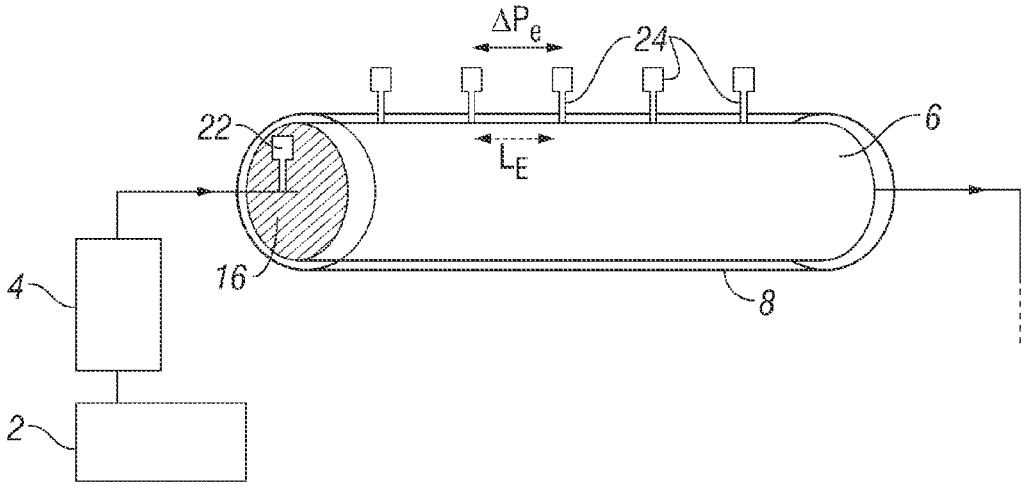
FIG. 4 shows a multi pressure tap/transducer core-flooding apparatus.

Additional experiments have shown that the pressure drop evolution described in FIG. 3, and obtained for self-diverting acid, is due to the existence of a region of low fluid mobility propagating ahead of the wormholes, or ahead of the dissolutions fronts in general. For illustration, a setup as in FIG. 1 is fitted with multiple pressure taps and transducers to measure the pressure along the core during the acid injection experiments, local pressure drops $\Delta p_e$ along the core can be measured. Such a new experimental setup is represented in FIG. 4, in which the inlet pressure tap and transducer is shown at [22] and additional pressure taps and transducers at distances down the core holder are shown at [24].

For a given pair of successive transducers (taps), $L_e$ is the distance between the two taps, $k_e$ is the permeability of the core and $\mu_e$ is the fluid viscosity between the two taps. According to Darcy's law regarding fluid flow, the measured parameters are interrelated:

$$Q = \frac{Ak_e}{\mu_e}\frac{\Delta p_e}{L_e} \quad (3)$$

where A is the cross sectional area of the core and Q is the rate of fluid flow. The fluid mobility $M_e$ is defined as:

$$M_e = \frac{k_e}{\mu_e} \quad (4)$$

With the apparatus in FIG. 4, one can:

measure $\Delta p_e$ for every pair of transducers, against time, and use equations (3) and (4) to determine the fluid mobility Me between every pair of transducers, against time From the knowledge of $M_e$ at any time, either an effective viscosity or an effective permeability can also be determined:

assuming the core permeability $k_0$ is unchanged, equation (4) gives $$\mu_e = \frac{k_0}{M_e} \quad (5)$$

assuming the acid viscosity $\mu_e$ is known, equation (4) gives:

$$k_e = \mu M_e \quad (6)$$

Figure 5:
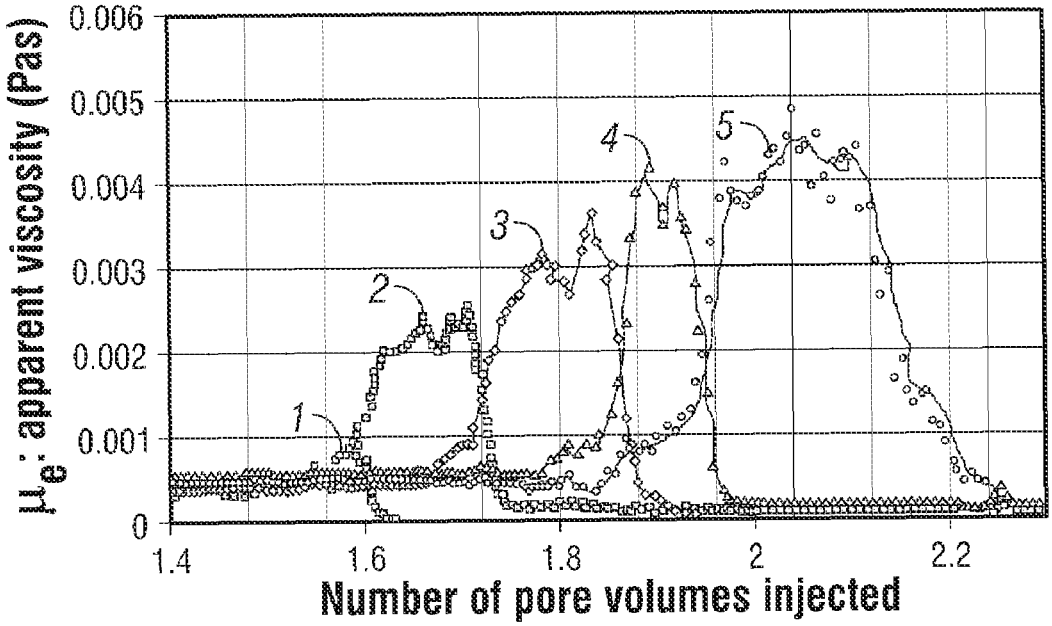
FIG. 5 shows the evolution of the effective viscosity $\mu_e$ with the number of pore volumes injected for a self-diverting acid.

The effective viscosity $\mu_e$ of the fluid flowing between pairs of transducers can be monitored against time, or equivalently, against the number of pore volumes injected. The results of one example of such monitoring are illustrated in FIG. 5. The five curves labeled 1, 2, 3, 4, and 5 in FIG. 5 are the values of $\mu_e$ calculated from equations (3), (4), and (5) at the five locations $L_e$ in FIG. 4.

Line number 1 (see FIG. 5) corresponds to the zone between the core inlet and the first pressure tap on the core. Line number 2 corresponds to the zone between the first and second pressure taps on the core. The other lines represent the remaining successive pairs in order.

Figure 6:
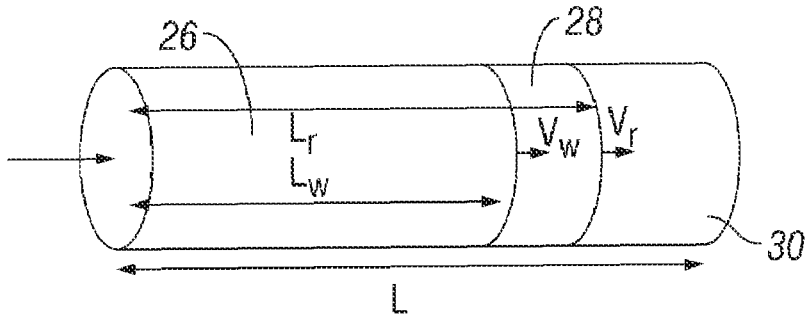
FIG. 6 illustrates a flow pattern in the core when a self diverting acid is pumped.

From FIG. 5, it can be seen that, as the self-diverting acid flows into the core, a first zone of finite effective viscosity $\mu_e$ propagates along the core (observed from the viscosity peaks) followed be a zone of virtually zero effective viscosity, or equivalently (using equation (4)), a zone of very large effective permeability $k_e$. The flow pattern in the core when acid is being pumped (from left to right as shown in the figure) can therefore be represented as in FIG. 6.

The zone of high fluid mobility [26] can be parameterized by an effective fluid mobility $M_e=M_w$ and a propagation velocity $V_w$. Equivalently, the zone can also be characterized by an effective fluid viscosity $\mu_w$ or an effective permeability $k_w$, derived according to equation (4).

Similarly, the zone of resistance or low fluid mobility [28] can be parameterized by an effective fluid mobility $M_e=M_r$ (and therefore according to Equation 4 an effective fluid viscosity $\mu_e=\mu_r$ or an effective permeability $k_e=k_r$), as well as a propagation velocity $V_r$. Finally, there is a zone of displaced fluid [30] that was originally in the core prior to injection.

The velocities can be determined as follows $$\begin{cases} V_w((Q/A), T, Ro, Ac) = \left(\frac{Q}{A}\right)\frac{1}{\theta_0((Q/A), T, Ro, Ac)} \\ V_r((Q/A), T, Ro, Ac) = \left(\frac{Q}{A}\right)\frac{1}{\theta_r((Q/A), T, Ro, Ac)} \end{cases} \tag{7}$$

The parentheses indicate that the velocities and pore volumes to breakthrough are themselves functions of fluid velocity Q/A, temperature T, rock formation Ro, and acid formulation Ac. The functions $\Theta_0$ and $\Theta_r$ are determined experimentally from the core flood experiments.

Using effective viscosities to express the effective mobilities, and rearranging the formulae, the effective viscosity $\mu_r$ is given by (8), and the derivation of (8) is given below.

$$\mu_r = \mu_d \frac{\Delta p_r}{\Delta p_0}\frac{\Theta_0}{\Theta_0 - \Theta_r} \tag{8}$$

Where $\mu_d$ is the viscosity of the displaced fluid, originally saturating the core before acid is injected; $\Delta p_0$ is the value of the pressure drop across the core when only the displaced fluid is pumped at the same conditions (typically brine). (8) is derived as follows. Let $L_w$ be the distance traveled by the wormholes, measured from the core inlet, during the core-flood experiment, where the fluid mobility is $M_w$ (see FIG. 6). Let $L_r$ be the distance traveled by the front of low fluid mobility, where the fluid mobility is $M_r$ (see FIG. 6). At the moment when $L_r=L$, L being the length of the core, $\Delta p_r$ is measured and using Darcy's law, we find that, $$\begin{aligned} \Delta p_r &= Q\frac{\mu_r}{Ak_0}(L - L_w) \\ &= Q\frac{\mu_r}{Ak_0}L\left(1 - \frac{\Theta_r}{\Theta_0}\right), \end{aligned} \tag{9}$$

and since, by definition, $$\Delta p_0 = Q\frac{\mu_d}{Ak_0}L, \tag{10}$$

we then find (8) by simple algebra.

For the zone of high fluid mobility, we find that the effective fluid viscosity $\mu_e=\mu_w$ in this region can be expressed as:

$$\mu_w = \mu_d \frac{\Delta p_{bt}}{\Delta p_0} \tag{11}$$

where $\Delta P_{bt}$ is the value of $\mu_p$ when the wormholes have broken through the outlet face of the core (this is the final value of $\Delta_p$). (11) is derived as follows. When, $L_w=L$, L being the length of the core, $\Delta p_{bt}$ is measured. Using Darcy's law, we then find that, $$\Delta p_{bt} = Q\frac{\mu_w}{Ak_0}L \tag{12}$$

then, using (10) and (12), we find (11) by simple algebra.

Equivalently, (8) and (11) can be used to define an effective mobility or an effective permeability in each zone, using Equation (4). This leads to equation (13).

$$\begin{cases} M_r = \dfrac{k_0}{\mu_d \dfrac{\Delta p_r}{\Delta p_0}\dfrac{\Theta_0}{\Theta_0 - \Theta_r}} \\ M_w = \dfrac{k_0}{\mu_d \dfrac{\Delta p_{bt}}{\Delta p_0}} \end{cases} \quad \begin{cases} k_r = \dfrac{k_0}{\dfrac{\mu_d}{\mu}\dfrac{\Delta p_r}{\Delta p_0}\dfrac{\Theta_0}{\Theta_0 - \Theta_r}} \\ k_w = \dfrac{k_0}{\dfrac{\mu_d}{\mu}\dfrac{\Delta p_{bt}}{\Delta p_0}} \end{cases} \tag{13}$$

Figure 7A:
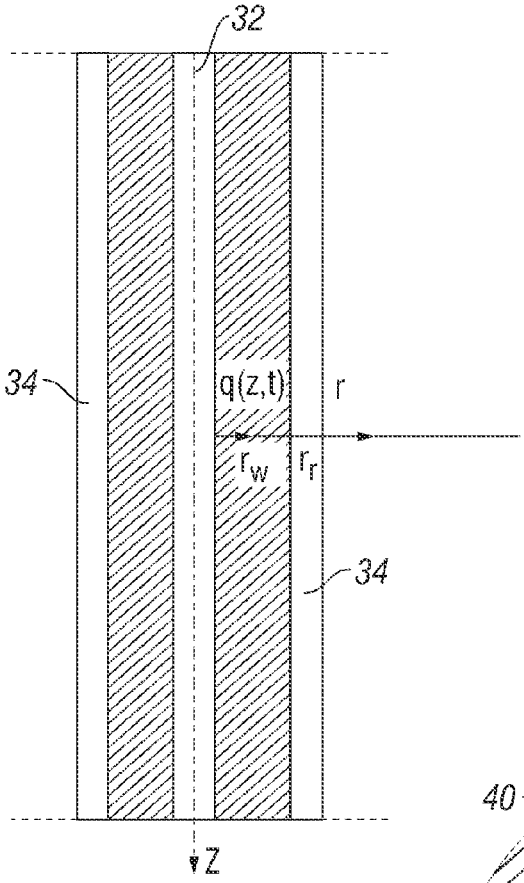
FIG. 7 illustrates axisymmetric flow around a wellbore.
Figure 7B:
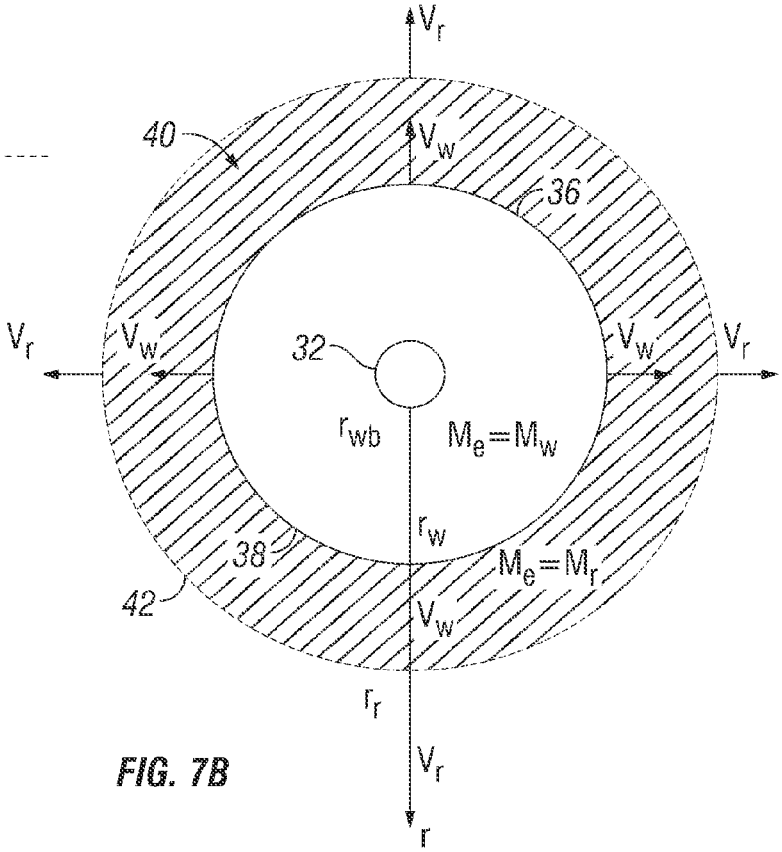

The use of Equations (8) and (11) in the case of axisymmetric radial flow around the wellbore in the reservoir as illustrated in FIGS. 7A and 7B. A wellbore [32] passes through a reservoir [34] and connects first to a wormholed or dissolved zone [36], bounded by a wormhole tip or dissolution front [38], and then to a resistance zone [40], bounded by a resistance zone front [42].

In FIGS. 7A and 7B, q(z,t) is the flow-rate per unit height into the reservoir at a time t, at a distance z along the wellbore. Let $r_w(z,t)$ be the radius of the wormhole-tip front or dissolution front and let $r_r(z,t)$ be the radius of the front of the resistance zone, both at the same time t and depth z. The evolution with time of both radii is then determined by solving the following set of equations.

$$\begin{cases} \frac{\partial}{\partial t}(r_w(z,t)) = \frac{V_w(V(z,r_w),\, T(z,r_w),\, Ro(z,r_w),\, Ac(z,r_w))}{\Phi_0(z,r_w)} \\ V(z,r_w) = \frac{q(z,t)}{2\pi r_w(z,t)} \end{cases} \quad (14)$$

$$\begin{cases} \frac{\partial}{\partial t}(r_r(z,t)) = \frac{V_r(V(z,r_r),\, T(z,r_r),\, Ro(z,r_r),\, Ac(z,r_r))}{\Phi_0(z,r_r)} \\ V(z,r_r) = \frac{q(z,t)}{2\pi r_r(z,t)} \end{cases} \quad (15)$$

Equations (14) and (15) are integrated by numerical means. Solving (14) and (15) allows the tracking of the wormhole tip and low-mobility front, respectively. In order to compute the pressure profile in the treated zone, i.e. at any z and for r between $r_{wb}$ and $r_r$, ($r_{wb}$ is the wellbore radius at the depth z and therefore the pressure in the wellbore during the treatment, we make use of $\mu_r$ as follows:

$$\begin{cases} V(z,r,t) = \frac{q(z,t)}{2\pi r} = -\frac{k_e(z,r,t)}{\mu_e(z,r,t)}\frac{\partial}{\partial r}p(z,r,t) \\ \mu_e(z,r,t) = \begin{cases} \mu & \text{if } r_{wb}(z) < r < r_w(z,t) \\ \mu_r & \text{if } r_w(z,t) < r < r_r(z,t) \end{cases} \\ k_e(z,r,t) = \begin{cases} k_w & \text{if } r_{wb}(z) < r < r_w(z,t) \\ k_0 & \text{if } r_w(z,t) < r \end{cases} \end{cases} \quad (16)$$

Equations (14)-(16) are integrated by analytical or numerical means and allow calculation of the pressure drop between the wellbore and $r_r$, anywhere along the wellbore. The pressure at the wellbore $p(z,r_{wb},t)$ can be determined from the pressure $p(z,r_r,t)$ at the resistance front using the following formula.

$$\begin{cases} p(z,r_{wb},t) = p(z,r_w,t) + \ln\left(\frac{r_w}{r_{wb}}\right)\frac{q(z,t)\mu}{2\pi k_w} \\ p(z,r_w,t) = p(z,r_r,t) + \ln\left(\frac{r_r}{r_w}\right)\frac{q(z,t)\mu_r}{2\pi k_0} \end{cases} \quad (17)$$

In (16) and (17), it is possible to substitute the effective viscosity $\mu_r$ and the effective permeability $k_w$ with other combinations giving rise to the same fluid mobility, for instance, (16) is equivalent to (18) and (17) to (19).

$$\begin{cases} V(z,r,t) = \frac{q(z,t)}{2\pi r} = -M(z,r,t)\frac{\partial}{\partial r}p(z,r,t) \\ M(z,r,t) = \begin{cases} M_w & \text{if } r_{wb}(z) < r < r_w(z,t) \\ M_r & \text{if } r_w(z,t) < r < r_r(z,t) \end{cases} \end{cases} \quad (18)$$

$$\begin{cases} p(z,r_{wb},t) = p(z,r_w,t) + \ln\left(\frac{r_w}{r_{wb}}\right)\frac{q(z,t)}{2\pi M_w} \\ p(z,r_w,t) = p(z,r_r,t) + \ln\left(\frac{r_r}{r_w}\right)\frac{q(z,t)}{2\pi M_r} \end{cases} \quad (19)$$

Figure 8:
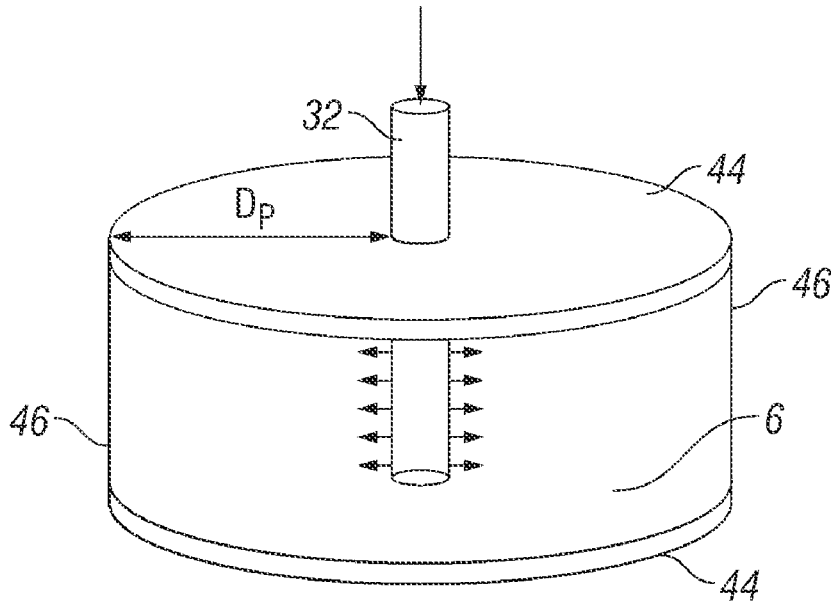
FIG. 8 shows an experimental setup for radial flow.
Figure 9:
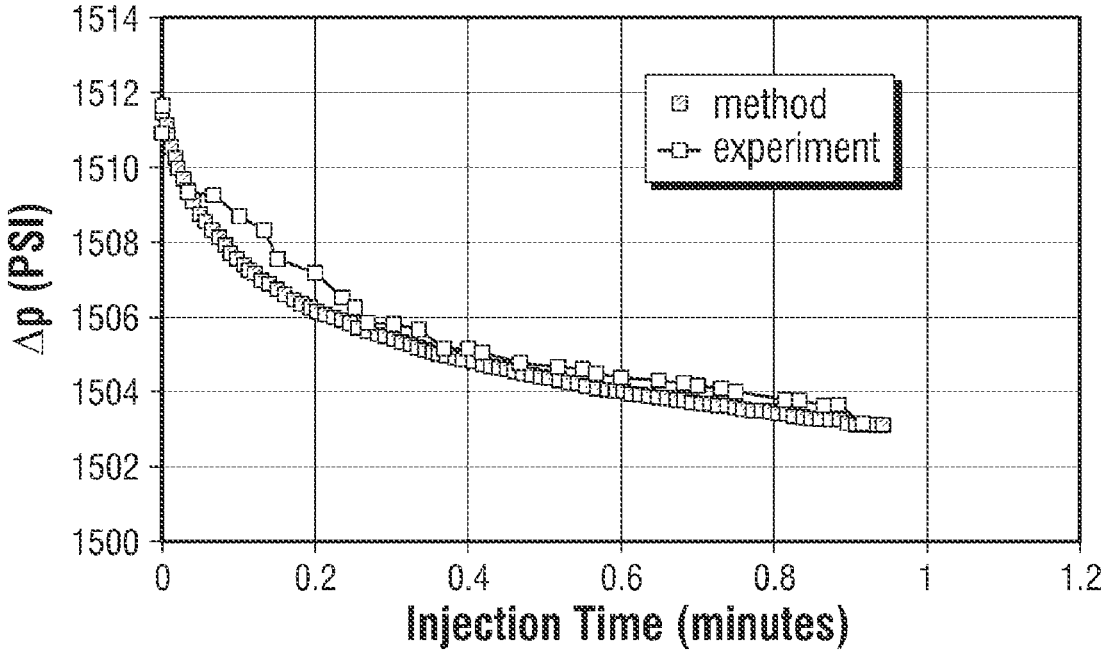
FIG. 9 gives a comparison between method and experiment for radial flow.

FIGS. 8 and 9 illustrate in a physical way the process described above. To illustrate, an experiment is conducted whereby acid (e.g. 15% HCl) is pumped from the top into a cylindrical core [6] held between two seals [44] as shown in FIG. 8. During the acid injection, performed at a constant flow-rate, the pressure difference between the wellbore [32] and the periphery of the core [46] is logged. The pressure drop is a direct indication of the distance traveled by the wormholes during this experiment. The agreement between the result predicted by the method and the experimental one is very good.

The procedural techniques for pumping stimulation fluids down a wellbore to acidize a subterranean formation are well known. The person who designs such matrix acidizing treatments has available many useful tools to help design and implement the treatments, one of which is a computer program commonly referred to as an acid placement simulation model (a.k.a., matrix acidizing simulator, wormhole model). Most if not all commercial service companies that provide matrix acidizing services to the oilfield have one or more simulation models that their treatment designers use. One commercial matrix acidizing simulation model that is widely used by several service companies is known as StimCADE™. This commercial computer program is a matrix acidizing design, prediction, and treatment-monitoring program that was designed by Schlumberger Technology Corporation. All of the various simulation models use information available to the treatment designer concerning the formation to be treated and the various treatment fluids (and additives) in the calculations, and the program output is a pumping schedule that is used to pump the stimulation fluids into the wellbore. The text "Reservoir Stimulation," Third Edition, Edited by Michael J. Economides and Kenneth G. Nolte, Published by John Wiley & Sons, (2000), is an excellent reference book for matrix acidizing and other well treatments.

As previously mentioned, because the ultimate goal of matrix acidizing is to alter fluid flow in a reservoir, reservoir engineering must provide the goals for a design. In addition, reservoir variables may impact the treatment performance.

In various embodiments, the overall procedure is implemented into an acid placement simulator to predict the fate of a given design in the field.

Figure 10:
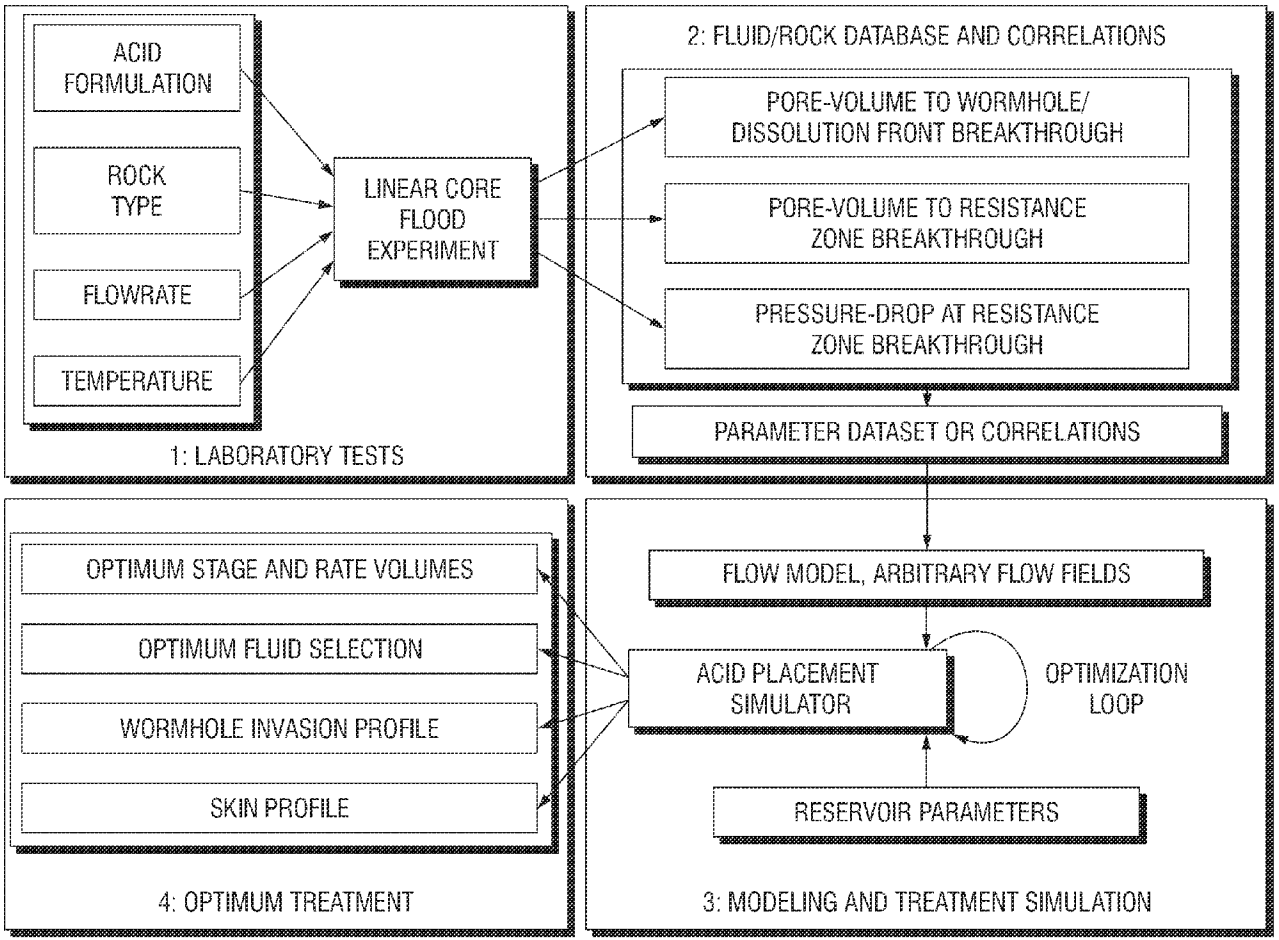
FIG. 10 shows a treatment design methodology in the field.

A global methodology used by field engineers is described in FIG. 10:

The optimization in FIG. 10 makes use of the above methodology to predict a given acid treatment performance. It is possible to improve a design by

- Changing operational parameters such as:
  - Pumping rate
  - Acid volume
  - Acid formulation
  - Number of acid stages
- Understanding important parameters controlling the treatment outcome such as:
  - Operational parameters
  - Reservoir parameters
  - Wellbore parameters
  - Conveyance parameters

EXAMPLES

A computer program has been developed to simulate the injection of acid into a carbonate reservoir. The simulator inputs include all the relevant reservoir parameters, schedule and fluid parameters.

- The simulator predicts the flow of the pumped fluids down the wellbore: location, concentration of acid along the wellbore vs. time and pressure distribution along the wellbore. This is done by mass conservation principle and by using hydrostatic and friction pressure models.
- The wellbore is connected to the reservoir and fluid from the wellbore will flow into the various reservoir layers if the pressure in the wellbore exceeds the pore-pressure in the reservoir. The initial pore pressure is a user input.

Once the stimulation fluids enter the reservoir at any given depth z along the wellbore, the dissolution fronts (also referred here as the high-mobility front or wormhole-tip front) at this depth, as well as the front of the zone of low mobility, if a self-diverting acid is being pumped) are tracked using equations (14) and (15).

The effect of acid flowing into the reservoir is to change the fluid mobility distribution and, therefore, the pressure in the reservoir changes. The pore pressure is updated using equations (16) and (17).

For the two above calculations to be possible, the flow-rate q must be known at the depth z under consideration. The flow-rate q can be estimated using equations (16) and (17) or any equivalent formulations before updating the fluid mobility distribution in the reservoir.

Then, the location of the dissolution fronts are updated over a certain time-step and the calculations are repeated until the full treatment schedule is complete.

Figure 11:
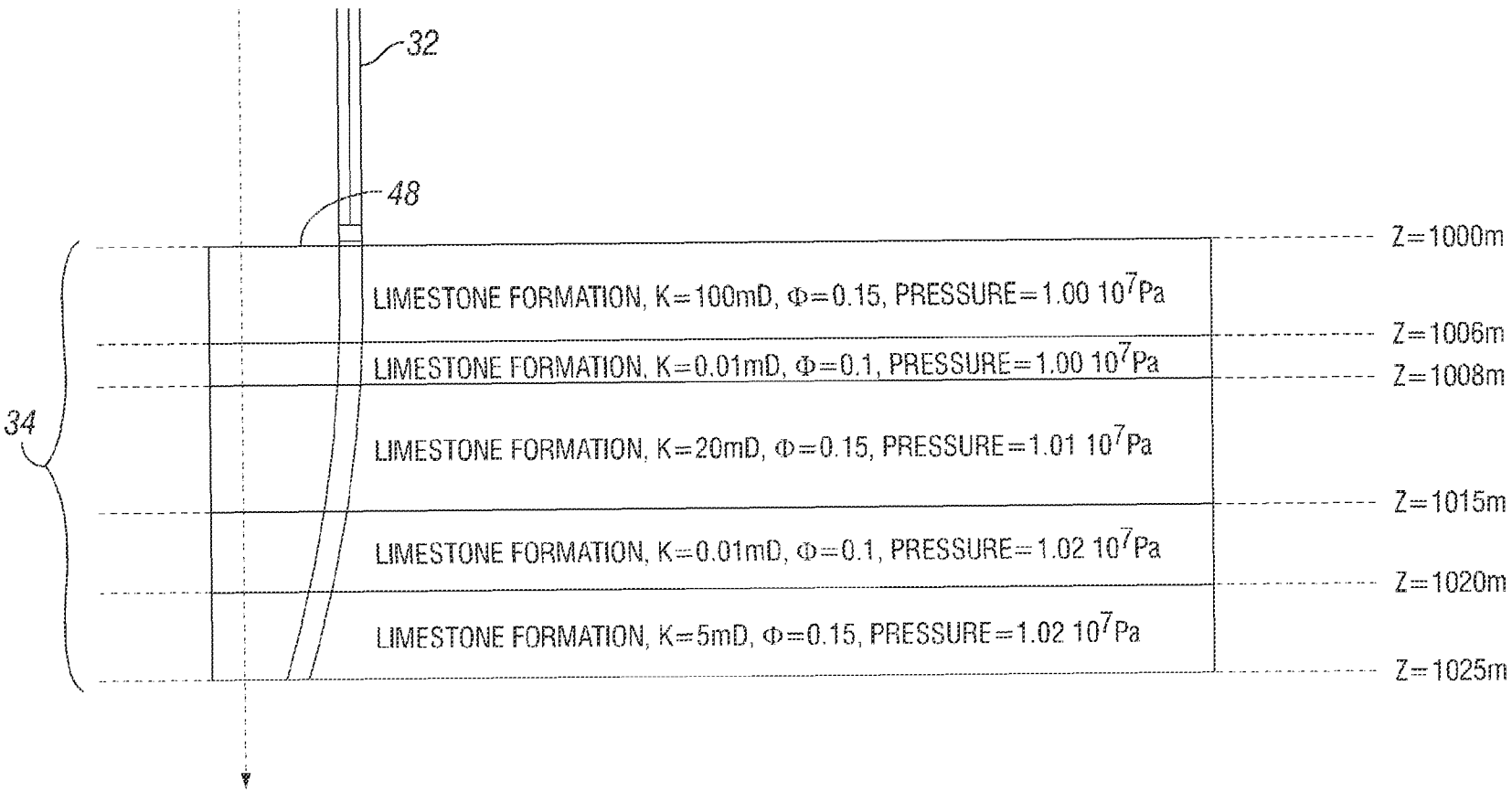
FIG. 11 is a diagram of a reservoir description and wellbore trajectory. The wellbore [32] enters the reservoir [34] at the reservoir top [48], and passes through multiple layers in the reservoir.
Figure 12A:
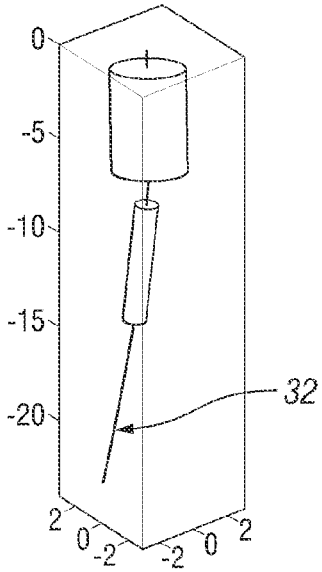
FIG. 12 shows HCl treatment results. The wellbore trajectory [32] is shown, along with stimulated regions [50] and virgin un-treated matrix [52].
Figure 12B:
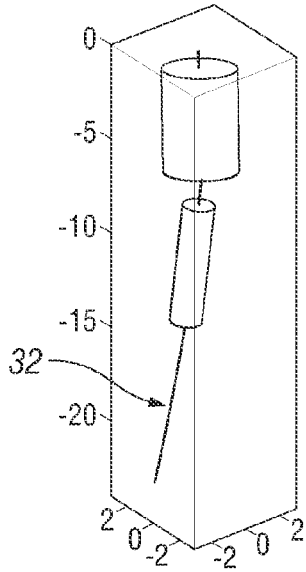
Figure 12C:
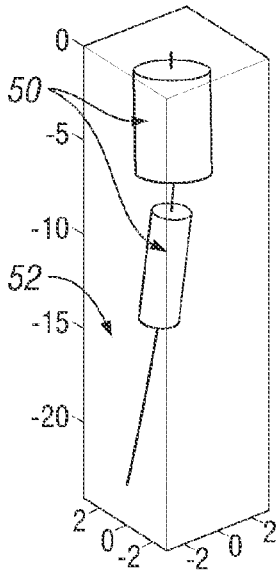
Figure 12D:
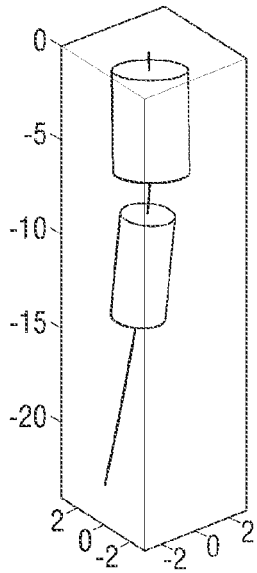
Figure 13A:
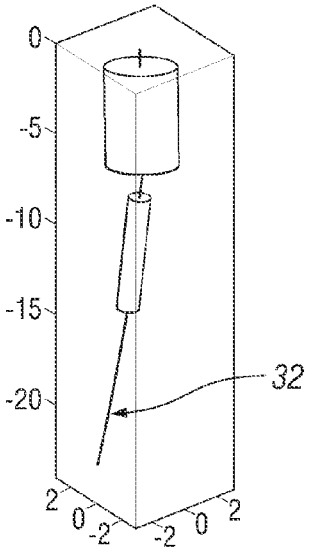
FIG. 13: VDA treatment results. The wellbore trajectory is shown, along with stimulated regions and virgin un-treated matrix.
Figure 13B:
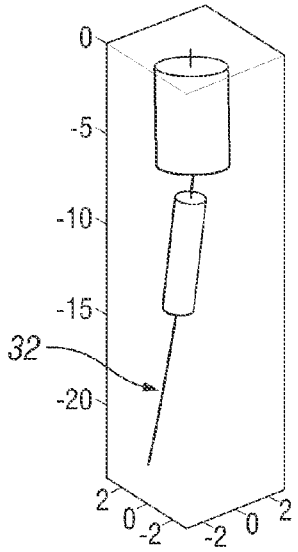
Figure 13C:
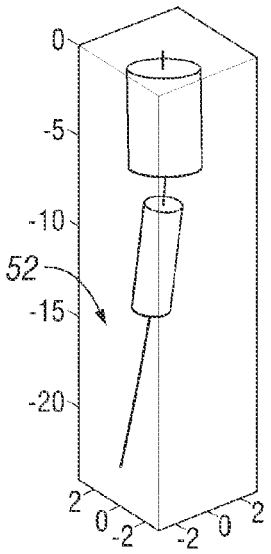
Figure 13D:
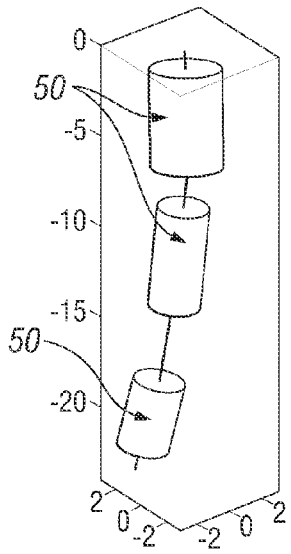

An example is given in FIG. 11: A well, partly deviated, is to be stimulated. The reservoir from which the well is producing is a limestone reservoir with three producing layers of 100, 20 and 5 mD as depicted in FIG. 12. The dimensions of the layers as well as their petrophysical properties are input into the simulator. These include Permeability, porosity Layer fluid saturations and fluid properties Layer dimensions, temperatures and pore pressures Drilling damage characteristics: skin and depth for each layer The well trajectory and dimensions are also input into the simulator. Finally, the type of completion used for this well is also input, in this case the wellbore is open-hole (no casing). The engineer's task is to design the best possible treatment. In other words, the engineer task is to ensure that he delivers the treatment the will provide the best stimulation given some economical and operational constraints.

First, acid core flood experiments, as described above, are performed using core samples from the layers of interest. These are used to calibrate the correlations for $\theta_r$ and $\mu_r$. $\theta_0$ is also determined. These tests are performed at the reservoir temperature, for various rates, and for the candidate stimulation fluids, in this case, 15% HCl and 15% VDA™. The parameters $\theta_r$, $\mu_r$ and $\theta_0$ are tabulated versus flux (V=q/A) and input into the simulator for the various flow-rates tested during the experiment. These tables, or correlations if correlations have been derived, are used in connection with equations (14)-(17) in order to predict the position of the front of the zone of high fluid mobility (where wormholes have increased the virgin permeability) and that of the zone of low fluid mobility.

The task now consists of optimizing acid volumes and rates in order to achieve an optimum treatment. Treatment efficiency is measured by comparing the wellbore skin before and after treatment. The further the wormholes extend into the layers, the lower the wellbore skin and the higher the production rate after treatment.

Figure 14:
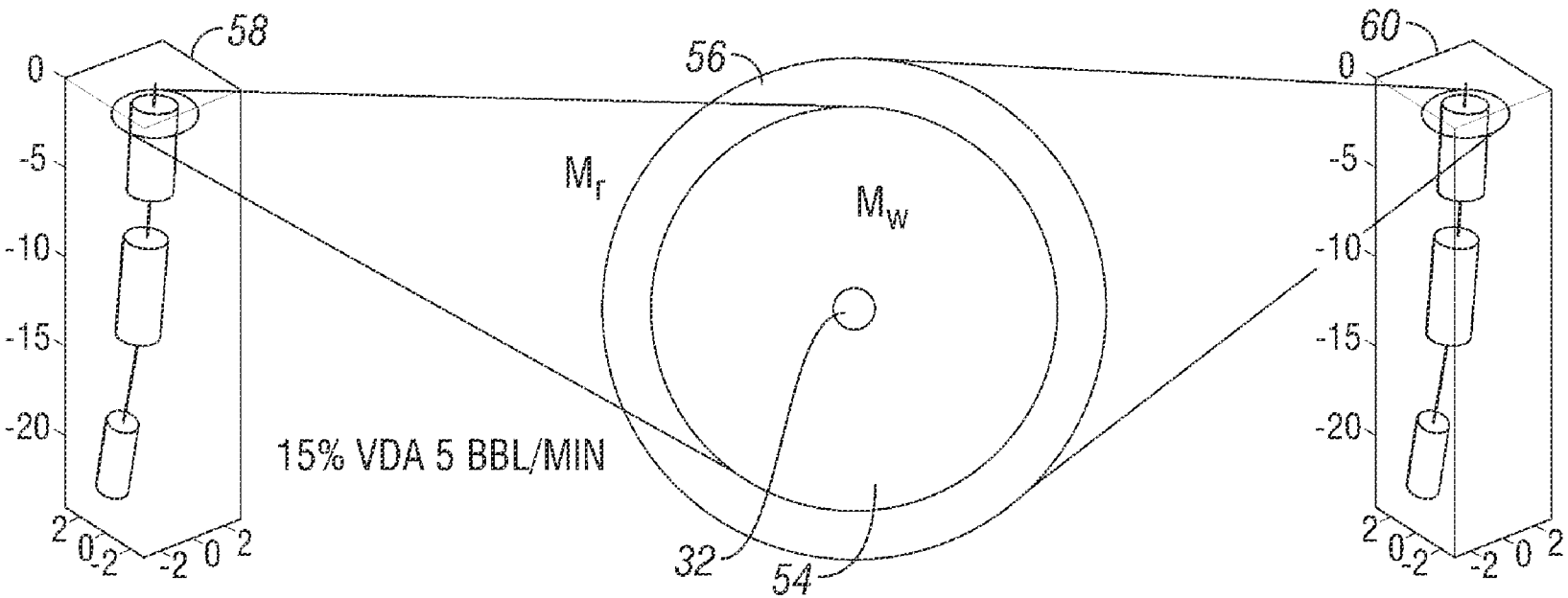
FIG. 14 shows the wellbore [32], a wormholed region [54], and a low-mobility region [56], in an optimized VDA treatment. A wormhole penetration profile [58] is shown on the left side of the figure and a low fluid mobility front penetration profile [60] is shown on the right side of the figure.

For such wells, a typical treatment consists of bullheading 15% HCl from the well-head at a constant rate. Given some operational constraints, the rate has to be between 0.5 bbl/min and 5 bbl/min in this example. For economical reasons, only 75 gal/ft of acid will be pumped. The first optimization step consists of running the simulator with different injection rates and choose that one providing the best treatment, with 15% HCl, the most economical acid system. The results are represented in FIG. 12A-12D. It is possible to see that the wormholes extended deeper into the top most-permeable layer of the reservoir that into the middle layer. The lower-permeability zone at the bottom does not get any stimulation. The best treatment with HCl is when the later is pumped at 5 bbl/min. The second step is to do the same exercise with 15% VDA. The results are represented in FIG. 13A-13D. Though wormholes do not propagate as far as with HCI in the top layer, the use of VDA pumped at 5 bbl/min shows that the zonal coverage is better and all layers show similar treatment depth. Because of the good zonal coverage and deep enough wormhole penetration (beyond the damage depth), the preferred treatment consists of pumping 15% VDA at 5 bbl/min. FIG. 14 also illustrates the position of the fronts of the zones of low fluid mobility, where $M=M_r$, responsible for the diversion.

What is claimed is:

1. A method of modeling the pressure in a wellbore during acid treatment with a self diverting acid delivered at a flowrate Q, the pressure being determined at a depth z, a distance r from the center of the well, and a time t, the method involving use of functions derived from core flooding experiments wherein a self diverting acid is injected into a core and the pressure along the core is measured as a function of time, the modeling method comprising:

calculating at least one of an effective viscosity $\mu_r$, a mobility $M_r$, and a permeability $k_r$, wherein $$\mu_r = \mu_d \frac{\Delta p_r}{\Delta p_o} \frac{\Theta_0}{\Theta_o - \Theta_r}$$

$$M_r = \frac{k_0}{\mu_d \frac{\Delta p_r}{\Delta p_0} \frac{\Theta_0}{\Theta_0 - \Theta_r}}$$

and $$k_r = \frac{k_0}{\frac{\mu_d}{\mu} \frac{\Delta p_r}{\Delta p_0} \frac{\Theta_0}{\Theta_0 - \Theta_r}}$$

wherein:

$k_0$ is the initial absolute permeability of the core, before acid is injected;

$\mu_d$ is the viscosity of the displaced fluid originally saturating the core before acid is injected;

$\mu$ is the viscosity of the acid;

$\Delta p_r$ is the pressure drop derived from the core flooding experiments and is the pressure drop at the time $t_r$ that the pressure drop changes from a first linear trend to a second linear trend;

$\Theta_r$ is the number of pore volumes delivered to the core at the time $t_r$;

$\Delta p_o$ is the pressure drop at t=o of the core flood experiment; and $\Theta_o$ is the pore volume to breakthrough measured in the core flood experiment; and using a simulator to calculate pressures within the formation on the basis of the effective viscosity $\mu_r$, the mobility $M_r$, and/or the permeability $k_r$.

2. The method according to claim 1, comprising deducing the pressure at the wellbore $p(z, r_{wb}, t)$ from the pressure at the resistance front $p(z, r_r, t)$ from $$p(z, r_{wb}, t) = p(z, r_w, t) + \ln\left(\frac{r_w}{r_{wb}}\right) \frac{q(z, t)\mu_w}{2\pi k_0}$$

wherein $$p(z, r_w, t) = p(z, r_r, t) + \ln\left(\frac{r_r}{r_w}\right)\frac{q(z, t)\mu_r}{2\pi k_0};$$

$$p(z, r_{wb}, t) = p(z, r_w, t) + \ln\left(\frac{r_w}{r_{wb}}\right)\frac{q(z, t)}{2\pi M_w}$$

wherein $$p(z, r_w, t) = p(z, r_r, t) + \ln\left(\frac{r_r}{r_w}\right)\frac{q(z, t)}{2\pi M_r};$$

or $$p(z, r_{wb}, t) = p(z, r_w, t) + \ln\left(\frac{r_w}{r_{wb}}\right)\frac{q(z, t)\mu}{2\pi k_w}$$

wherein $$p(z, r_w, t) = p(z, r_r, t) + \ln\left(\frac{r_r}{r_w}\right)\frac{q(z, t)\mu}{2\pi k_r}$$

wherein z is the depth in the wellbore;

$r_{wb}$ is the radius of the wellbore at a depth z;

$r_w$ is the radius of the dissolution front or the zone of high fluid mobility $r_r$ is the radius of the zone of resistance at a depth z and at a time t;

q is the flow rate of self-diverting acid in the formation at a depth z and at a time t;

μ is the viscosity of the self-diverting acid before the acid is spent; and $k_w$ is the effective permeability in the region of high fluid mobility.

3. A method of optimizing acid treatment of a hydrocarbon containing carbonate reservoir with a self-diverting acid, comprising:

carrying out linear core flood experiments varying one or more parameters selected form the group consisting of acid formulation, rock type, flow rate, and temperature;

deriving the following functions from the experiments, as a function of the parameters:

$\Theta_o$—the pore volume to wormhole/dissolution front breakthrough;

$\Theta_r$—the pore volume to resistance zone breakthrough; and $\Delta p_r$—the pressure drop at resistance zone breakthrough;

writing equations of a flow model based on the functions;

solving the equations in an arbitrary flow field in a simulator;

using the simulator in an optimization loop together with known and/or estimated reservoir parameters; and calculating at least one of the following from the simulator optimization loop:

stage and rate volumes of the acid treatment;

fluid selection for the acid treatment;

wormhole invasion profile; and skin profile.

4. A method according to claim 3, comprising deriving fluid mobilities in the resistance zone and in a zone of large mobility on the basis of Darcy's law from measurements of pressure drop along the core in the core flood experiments.

5. A method according to claim 3, comprising optimizing at least one of the pumping rate;

acid volume;

acid formulations; and number of acid stages.

* * * * *